United States Patent [19]

Kivikas et al.

[11] 4,301,864

[45] Nov. 24, 1981

[54] PLATE HEAT EXCHANGER

[75] Inventors: Toivelemb Kivikas, Lund; Kaj Rissler, Helsingborg; Dag Rynell, Loddekopinge; Malte Skoog, Lund, all of Sweden

[73] Assignee: Alfa-Laval AB, Tumba, Sweden

[21] Appl. No.: 55,699

[22] Filed: Jul. 9, 1979

[30] Foreign Application Priority Data

Jul. 10, 1978 [SE] Sweden ..... 7807676

[51] Int. Cl.[3] ..... F28F 3/08; F28F 9/22; F28F 13/06

[52] U.S. Cl. ..... 165/167; 165/174

[58] Field of Search ..... 165/146, 147, 166, 167, 165/174

[56] References Cited

U.S. PATENT DOCUMENTS 1,748,121 2/1930 Gay ..... 165/174

FOREIGN PATENT DOCUMENTS 464004 4/1937 United Kingdom ..... 165/166

1211065 11/1970 United Kingdom ..... 165/166

*Primary Examiner*—Sheldon J. Richter

*Attorney, Agent, or Firm*—Cyrus S. Hapgood

[57] ABSTRACT

In a plate heat exchanger having a large number of heat exchanging passages connected in parallel, the distribution of the flow between the passages will be unequal in that a larger flow passes through passages which are close to the inlets and outlets than through passages far away therefrom. To eliminate this problem, the passages are provided with means for regulating the flow resistance, said means being arranged so that passages which are situated farther away from the inlets and outlets have lower flow resistance than passages closer to said inlets and outlets.

6 Claims, 1 Drawing Figure

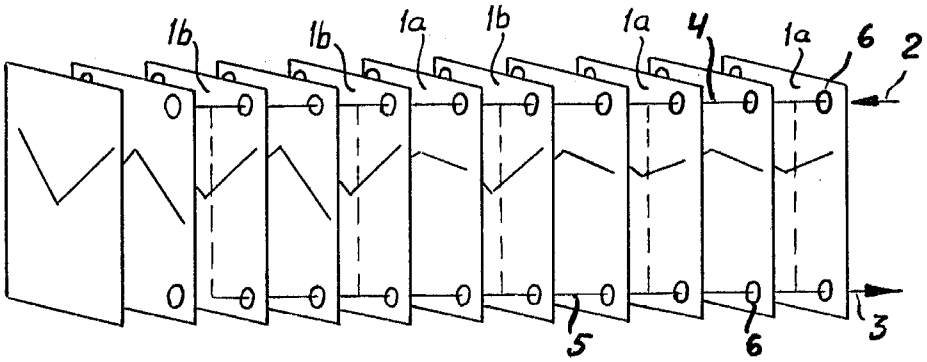
2
6
1a
4
1a
1b
1a
1b
1b
3
6
5

PLATE HEAT EXCHANGER

The present invention relates to heat exchangers of the kind comprising a plurality of generally rectangular plates arranged adjacent to each other and defining intermediate passages connected in parallel for receiving heat exchanging fluids which are conveyed to and from the heat exchanger via inlets and outlets provided at one end thereof, the plates being provided at their corner portions with ports forming inlet and outlet ducts between the heat exchanging passages and the inlets and outlets, respectively.

In conventional plate heat exchangers of this kind, in which all the passages for at least one heat exchanging fluid have equal flow resistance, it has appeared that the mutual distribution of the flow amounts between these passages will be unequal in that a larger flow amount passes through the passages disposed closer to the inlets and outlets of the heat exchanger than through the passages disposed further away from said inlets and outlets. This is due to the pressure drop occurring in the inlet and outlet ducts extending through the plate pack, said ducts being formed by the ports provided in the corner portions of the plates. This pressure drop occurs because the driving pressure difference between the inlet and outlet of the heat exchanging passages will be higher in the passages situated closer to the inlets and outlets of the heat exchanger than in the passages which are further away therefrom, which in turn results in a larger flow in the former passages than in the latter.

Especially in heat exchangers having a large number of heat exchanging passages connected in parallel, the above-described state of things may cause a considerably unequal distribution of the flow within the plate pack. This, in turn, results in a deteriorated efficiency of the heat exchanger in that the passages which are far from the inlets and outlets are not fully utilized.

In order to overcome this problem, it has been proposed to use flow distributing means disposed in the inlet and outlet ducts extending through the plate pack, whereby a fairly equal driving pressure difference has been obtained for passages which are close to the inlets and outlets of the heat exchanger and for passages further away therefrom. However, this solution results in an undesirable increase of the total pressure drop through the heat exchanger.

By using a plate heat exchanger made in accordance with the present invention, it is possible to obtain an essentially uniform distribution of the flow throughout the plate pack, without any influence on the driving pressure difference. This thus means that the flow through all the heat exchanging passages connected in parallel will be substantially equal irrespective of their distance from the inlets and outlets of the heat exchanger.

A heat exchanger made according to the invention is characterized mainly in that the passages are provided with means for regulating the flow resistance, said means being arranged so that the flow resistance of the heat exchanging passages for at least one of the fluids varies in relation to the distance from the inlets and outlets in such way that passages which are further away from the inlets and outlets have a lower flow resistance than passages which are situated closer to said inlets and outlets.

In a heat exchanger made in this way, it is possible to obtain equal or fairly equal flows in all the heat exchanging passages, the relatively high pressure drop in the passages nearest the inlets and outlets being utilized by imparting a heavier turbulence to the heat exchanging fluids which in turn results in an improved heat transmission.

If an exactly equal flow is to be obtained in all the passages connected in parallel, each passage must have a slightly less flow resistance than the adjacent passage which is closer to the inlets and outlets. However, for practical reasons, the number of passages having different flow resistances must often be restricted. It appears suitable to arrange passages with equal flow resistances in groups which may be either equally or differently large, the flow resistance in each separate passage being less in a group farther away from the inlets and outlets of the heat exchanger than in a group which is nearer to said inlets and outlets. With regard to flow distribution, the larger the number of groups, the greater the advantages which are obtained; but even only two groups result in a considerable improvement.

The invention will be described in more detail with reference to the accompanying drawing, in which the single illustration shows a preferred embodiment of the new heat exchanger in a perspective, exploded diagrammatical view.

The heat exchanger shown in the drawing comprises a series of plates 1*a* and 1*b* between which are formed heat exchanging passages for receiving the flow of heat exchanging fluids. The flow paths for one of the fluids are indicated by arrows, this fluid entering through an inlet 2 and departing through an outlet 3, the fluid being distributed to all its heat exchanging passages via inlet and outlet ducts 4 and 5, formed by ports 6 at the corner portions of the plates. The plates are corrugated in a so-called herringbone pattern, as indicated in the drawing. The corrugation is made with two different angles, the plates 1*a* having a larger and the plates 1*b* having a smaller angle of corrugation.

Depending on the chosen angle of corrugation, the flow resistance of the intermediate passage will be different, and by combining the plates in the manner shown in the FIGURE, passages having three different degrees of flow resistance are obtained. The passages nearest to the inlets and outlets have the highest flow resistance due to the fact that the plates 1*a* which are used there have the largest angle of corrugation. In the middle passages for which plates 1*a* and 1*b* having a large and a small angle of corrugation, respectively, are arranged alternately, the flow resistance is somewhat lower. Finally, the passages situated farthest from the inlets and outlets, and defined by plates 1*b* having the smaller angle of corrugation, have the lowest flow resistance. The heat exchanging passages are thus arranged in groups, the flow resistance of which is reduced step by step, the passages nearest to the inlets and outlets having the highest and the passages at the opposite end of the heat exchanger having the lowest flow resistance. The pressure drop occurring in the flow direction in the inlet duct 4 and outlet duct 5 of the heat exchanger is thus compensated for, and consequently the flow through all the heat exchanging passages will be essentially equally large.

In the above-described embodiment, the flow resistance of the heat exchanging passages is varied by changing the angle of the corrugation of the plates. However, the flow resistance may also be varied in any other way within the scope of the invention. Instead of changing the angle of corrugation, the same result can thus be obtained by varying the depth of the section of the corrugation pattern of the plates. Plates having a less depth of said section will provide intermediate passages having a higher flow resistance and should be disposed nearest the inlets and outlets, while plates having a deeper section form intermediate passages having lower flow resistance and which are to be used further away from said inlets and outlets.

It will be understood that the heat exchanging passages are confined by marginal gaskets (not shown) compressed between adjacent plates, as is conventional, and that the passages alternating with those for the above-mentioned one fluid are used for flow of the other heat exchanging fluid, as is conventional.

We claim:

1. A heat exchanger comprising a plurality of generally rectangular plates arranged adjacent to each other and defining intermediate passages connected in parallel for receiving heat exchanging fluids which are conveyed to and from the heat exchanger via inlets and outlets at one end thereof, the plates being provided at their corner portions with entrance ports and exit ports through which each said fluid is conducted from a said inlet to a said outlet by way of a plurality of said intermediate passages alternating with others of said intermediate passages, each said passage having means for regulating the resistance to flow therethrough from a said entrance port to a said exit port, said regulating means providing different said flow resistances through some of the intermediate passages for one of said fluids than through other said passages for said one fluid, said means being arranged to provide passages for said one fluid which are farther from said inlets and outlets with lower flow resistances than passages for said one fluid which are closer to said inlets and outlets.

2. The exchanger of claim 1, in which said regulating means comprise corrugations forming an angle with the longitudinal axis of the plates, said angle varying in relation to the distance of the plates from the inlets and outlets.

3. The exchanger of claim 2, in which the corrugations of the plates disposed closer to the inlets and outlets form a wider angle with the longitudinal axis of the plates, the corrugations of the plates farther from the inlets and outlets forming a smaller angle with said axis.

4. The exchanger of claim 1, in which said regulating means comprise corrugations having varying depth of section, plates having smaller depth of section being disposed closer and plates having greater depth of section being disposed farther from the inlets and outlets.

5. The exchanger of claim 1, in which said heat exchanging passages are arranged in at least two groups, the passages in each group having equal flow resistances but flow resistances which differ from those of the passages in another group.

6. The exchanger of claim 5, in which there are three of said groups.

* * * * *